United States Patent [19]

Bachhuber et al.

[11] 3,973,465

[45] Aug. 10, 1976

[54] AUTOMATIC PRIMER FEED FOR SHOTGUN SHELL RELOADER

[75] Inventors: Theodore J. Bachhuber; Philip C. Bachhuber, Jr., both of Mayville, Wis.

[73] Assignee: Mayville Engineering Company Incorp., Mayville, Wis.

[22] Filed: Mar. 24, 1975

[21] Appl. No.: 561,120

[52] U.S. Cl. ..... 86/45; 86/23; 86/36

[51] Int. Cl.[2] ..... F42B 33/00

[58] Field of Search ..... 86/45, 46, 23, 36

[56] References Cited

UNITED STATES PATENTS

| | | | |
|---|---|---|---|
| 2,794,359 | 6/1957 | Lyman et al. | 86/45 X |
| 3,240,103 | 3/1966 | Lamont | 86/45 X |

*Primary Examiner*—Stephen J. Lechert, Jr.

*Attorney, Agent, or Firm*—Wheeler, Morsell, House & Fuller

[57] ABSTRACT

A primer tray is mounted on the tool carriage of a shotgun shell reloader and is tilted to urge the primers therein toward a dispenser opening in one corner of the tray. A dispenser arm moves one of the primers over the dispenser opening when the reloading tools on the tool carriage are moved to contact shotgun shells on the reloader's work table. A dispenser tube is attached to the bottom of the primer tray under the dispenser opening and guides the primer to a predetermined primer delivery point on the work table. In one embodiment, the primer dispenser tube is within the ram which seats the primer in the base of the shotgun shell. In another embodiment, the primer dispenser tube is adjacent to the primer seating ram.

13 Claims, 9 Drawing Figures

Fig. 5
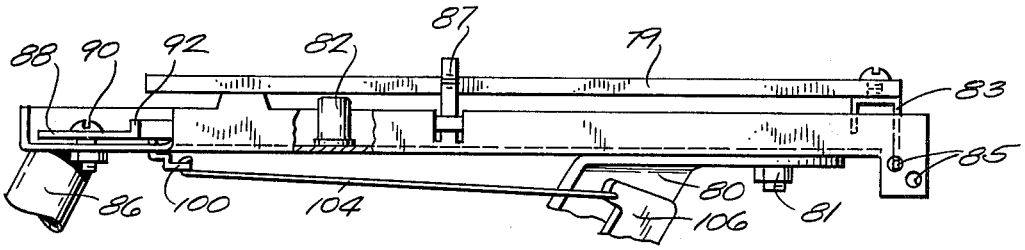
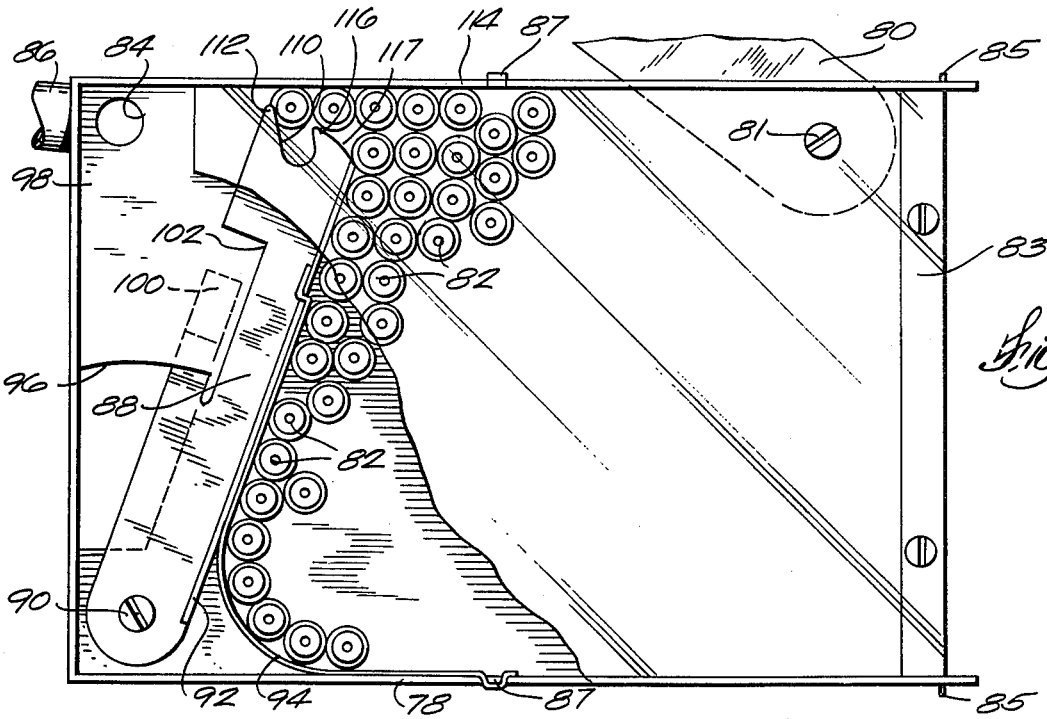
Fig. 4
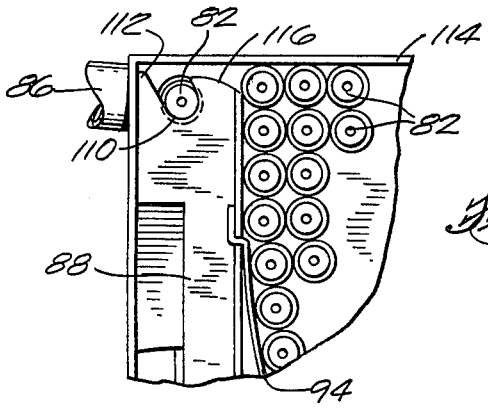
Fig. 6

AUTOMATIC PRIMER FEED FOR SHOTGUN SHELL RELOADER

BACKGROUND OF THE INVENTION

This invention relates to an automatic primer feed mechanism for shotgun shell reloaders. Known shotgun shell reloaders have included work stations with apparatus for ejecting the spent primer from a used shotgun shell, for seating a new primer in the base of the shell, for inserting a charge of powder, wadding, and a charge of shot into the shell, and for crimping the end of the shell. These operations were performed either in sequence (on one shell) or simultaneously (on a series of shells), by means of a hand actuated lever which produced relative motion between a tool carriage which supported the reloading tools and a work table upon which the shell or shells were supported. The reloader included a container for powder, a container for shot, a slide valve for metering the charges of powder and shot, and a tube or tubes through which the charges of powder and shot were supplied to the shotgun shell. However, there was no provision for supplying primers. This had to be performed manually.

SUMMARY OF THE INVENTION

This invention provides an automatic primer feed mechanism which can be used in combination with a shotgun shell reloader of the type described. The primer feed mechanism includes a primer tray attached to the reloader's tool carriage, a primer dispenser opening in the bottom of the primer tray, biasing means urging primers toward the opening, such as tilting the tray for gravity feed toward the opening, dispenser means for moving primers one at a time over the dispenser opening, a dispenser tube attached to the bottom of the primer tray under the dispenser opening and extending downwardly to a predetermined primer delivery point on the reloader's work table, and means for actuating the dispenser means to drop a primer down the dispenser tube at a predetermined time with respect to the other operations performed by the loader. In one embodiment, the primer dispenser tube is within the ram which seats the primer in the base of the shotgun shell. In another embodiment, the primer dispenser tube is adjacent to the primer seating ram.

Agitation means to assure an even supply of primers toward the dispenser opening, and cover means adjustable for keeping primers of various sizes confined to upright orientation are also desirable features.

DESCRIPTION OF THE DRAWINGS

FIG. 4 is a top view of the primer tray shown in FIGS. 1 and 2.

FIG. 5 is a side view of the primer tray shown in FIG. 4.

FIG. 6 is a fragmentary top view of the corner of the primer tray of FIGS. 4 and 5, with the dispenser arm in position to drop a primer through the dispenser opening thereof.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
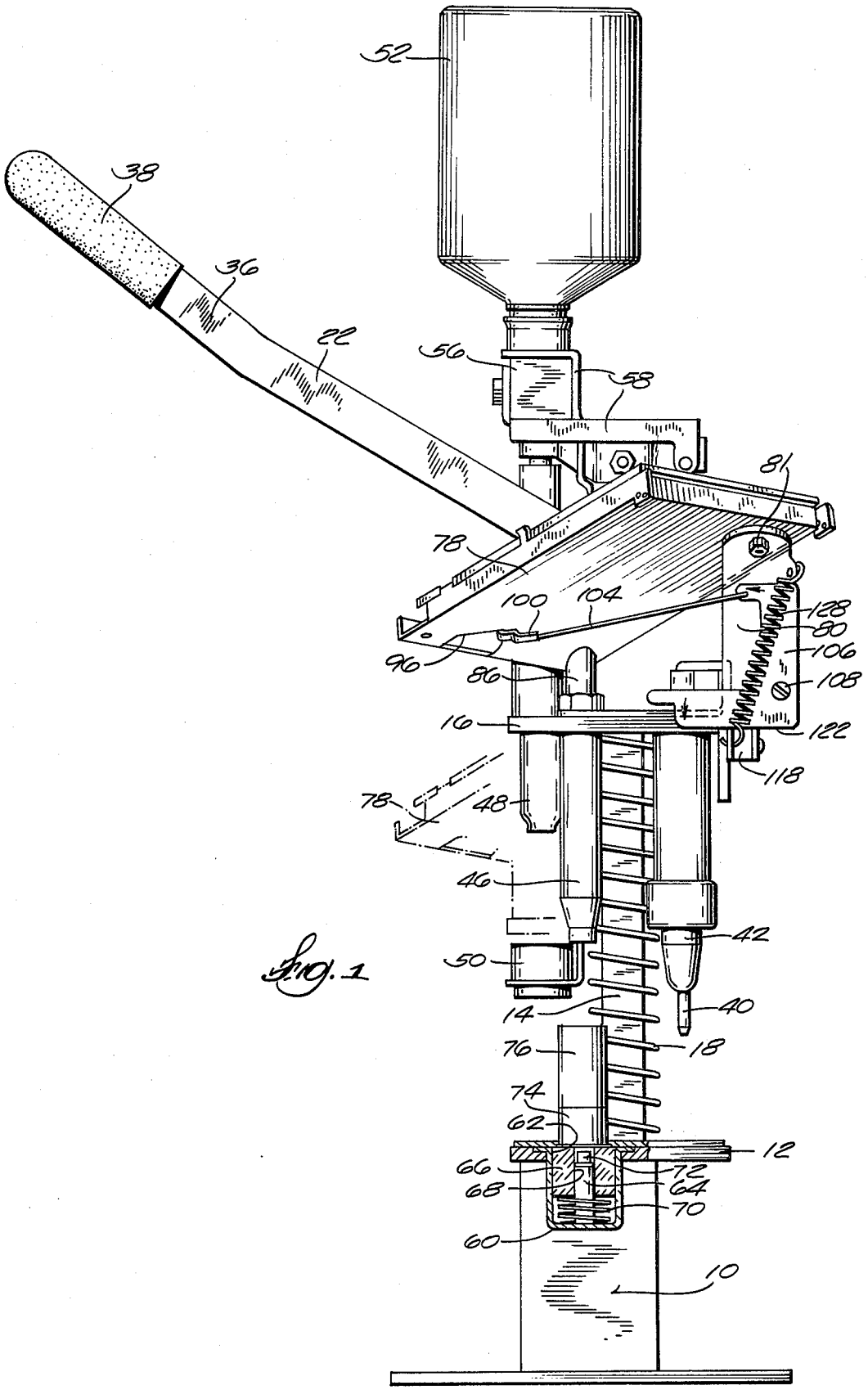
FIG. 1 is a side elevational view of one embodiment of the invention mounted on a first type of shotgun shell reloader.
Figure 2:
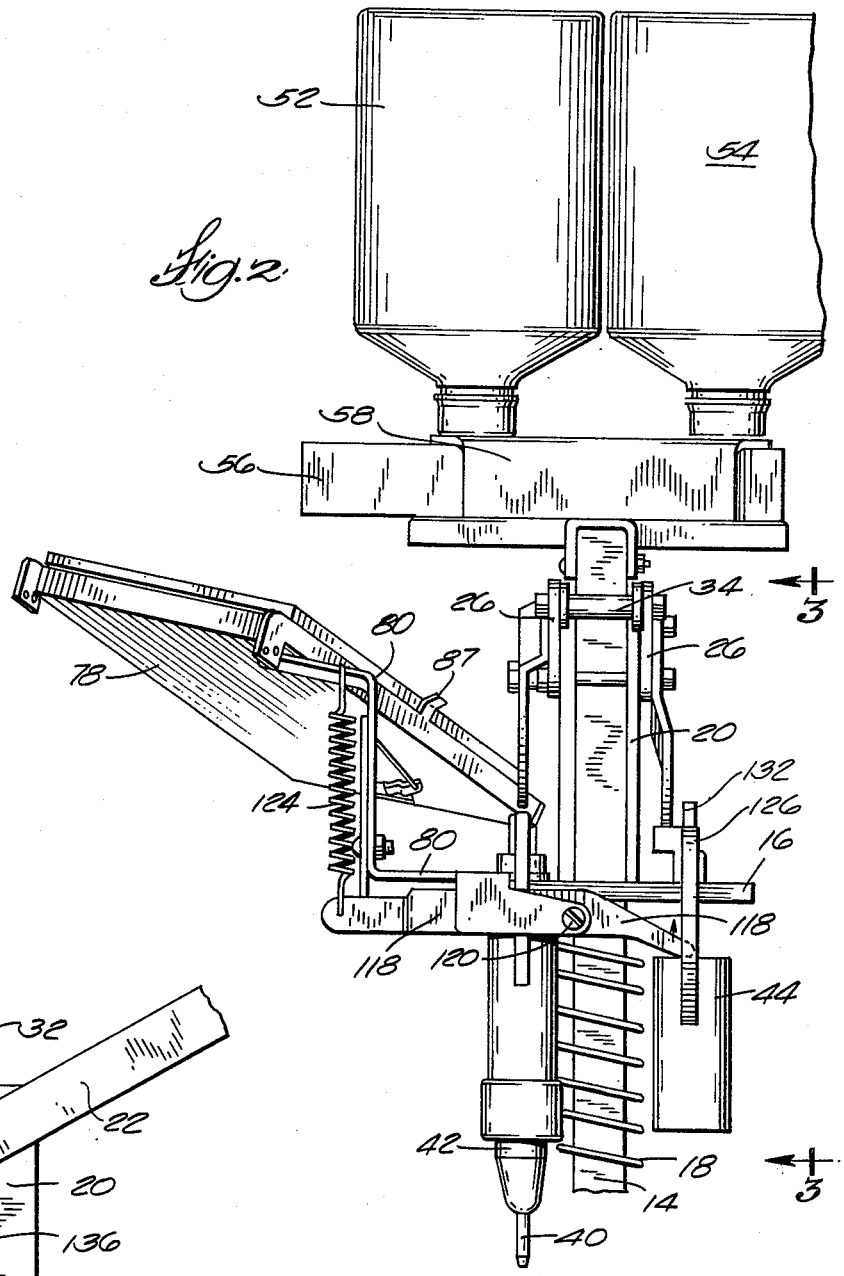
FIG. 2 is a rear elevational view of the upper part of the embodiment shown in FIG. 1.
Figure 3:
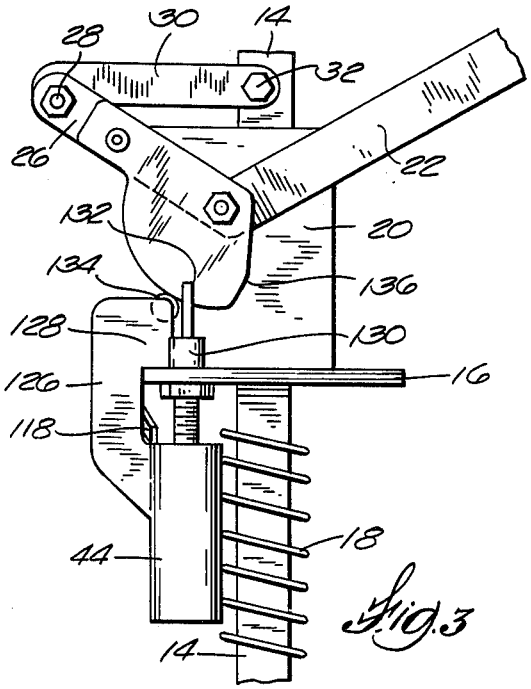
FIG. 3 is a fragmentary side elevational view taken on the line 3—3 of FIG. 2.

FIGS. 1–6 show one embodiment of the invention mounted on a first type of shotgun shell reloader which includes a base 10, a work table 12 supported on base 10, a post 14 attached to base 10 and extending upwardly through the center of work table 12, and a tool carriage 16 slideably mounted on post 14 and normally spring biased away from work table 12 by a compression spring 18. As best shown in FIG. 3, tool carriage 16 has a bracket 20 attached thereto to which a lever arm 22 is pivotally connected at 24. Lever arm 22 has a forward portion 26 that extends past pivot connection 24 and forms an obtuse angle with lever arm 22. Forward portion 26 is pivotally connected at 28 to a link 30 which is pivotally connected at 32 to post 14. Another lever arm 22 connected at its free end to the first lever arm 22 to form a forked lever similarly has a forward portion 26 pivotally connected to another link 30 on the opposite side of bracket 20, the ends of the forward portions 26 and links 30 being spaced apart by a spacer sleeve 34 (FIG. 2). The opposite ends of the two lever arms 22 are joined together at 36 (FIG. 1) and carry a common handle 38. When handle 38 is pulled down, lever arms 22 force bracket 20 and tool carriage 16 downwardly against the bias of spring 18. When handle 38 is released, spring 18 pushes tool carriage 16 and bracket 20 upwardly to the position shown in FIG. 1.

A plurality of known reloading tools are attached to tool carriage 16 and project downwardly therefrom toward work table 12, which is adapted to support shotgun shells that are to be reloaded. The reloading tools include a primer ejection punch 40, a sizing die 42, a crimping die 44 (FIG. 2), a primer dispenser tube and primer inserting ram 46 (FIG. 1), a powder and shot tube 48, and a wad support 50. Powder and shot tube 48 is connected to a powder container 52 and shot container 54 (FIG. 2) via a conventional slide valve 56, the containers 52 and 54 being mounted on a bracket 58 attached to the top of post 14.

In this particular type of reloader, shotgun shells are reloaded one at a time. The shell which is being reloaded is first placed in a work station under primer ejection punch 40 and handle 38 is pulled down to ram punch 40 against the spent primer to eject it from the shell. The ejected primer falls through an opening in work table 12 under punch 40. As the spent primer is being ejected, sizing die 42 moves within the shell to size it. Handle 38 is then released and spring 18 forces tool carriage 16 upwardly, which withdraws punch 40 and sizing die 42 from the shell. The shell is then moved to a station under primer tube and inserting ram 46 to have a fresh primer seated into the base of the shell.

A primer support cup 60 (FIG. 1) is seated in an opening 62 in work table 12 under primer tube and inserting ram 46 and extends downwardly underneath work table 12. A cylindrical primer support anvil 64 is supported in the center of cup 60 and projects upwardly toward work table 12. A collar 66 having a central opening 68 surrounds anvil 64 and is spring loaded upwardly by compression spring 70. In the operation of this embodiment, a fresh primer 72 is within opening 68 before the empty shell is placed on collar 66. The fresh primer 72 is dropped down the hollow interior of primer tube and inserting ram 46 when the bottom of tube 46 is adjacent to collar 66. The mechanism which drops the primer 72 down tube 46 is described in later paragraphs. After the fresh primer 72 is dropped in opening 68, the base 74 of the empty shell 76 is placed on collar 66 and handle 38 is pulled down to move primer tube and inserting ram 46 down into the empty shell 76. When the bottom of ram 46 contacts the interior of shell base 74, it presses shell base 74 down on collar 66, which yields and moves downward against spring 70. However, the fresh primer 72 is held stationary by anvil 64, and as the shell base 74 moves down, the fresh primer 72 is pressed into the primer opening in shell base 74. Alignment is assured by the shell aligning flange at the work station (similar to slot 162, FIG. 9) and the fixed relation between the primer tube and the ram. After the fresh primer 72 is fully seated in shell base 74, which occurs at the bottom of the downward stroke of handle 38, the handle 38 is released to allow primer tube and inserting ram 46 to withdraw from the empty shell 76, which can then be moved under powder and shot tube 48 to be charged with powder and shot. Since this invention is only concerned with the primer feed mechanism, the charging of shell 76 with powder and shot and its subsequent crimping will not be described in detail herein.

The primer feed mechanism in this embodiment includes a primer tray 78 which is rigidly attached to tool carriage 16, for instance by a bracket 80 which is bolted to the bottom of tray 78 at 81. Tray 78 is dimensioned to hold a single layer of primers 82 (FIG. 4) and has a primer dispenser opening 84 in one corner and a primer dispenser tube 86 (FIGS. 1 and 5) welded to the bottom of tray 78 under dispenser opening 84. Dispenser tube 86 is connected to the top of primer tube and inserting ram 46 (FIG. 1) which serves as an extension thereof. Primer tray 78 is angled upward away from the corner bearing dispenser opening 84 in order to gravity bias the primers 82 toward dispenser opening 84. Primers 82 are normally blocked from entering dispenser opening 84 by a dispenser arm 88 (FIG. 4) which is pivotally attached at 90 to the corner of tray 78 opposite dispenser opening 84 and extends across the tray. Dispenser arm 88 has an upturned flange 92 on the edge thereof adjacent to primers 82 to present a flat surface to the sides of the primers. A flexible strip 94 (FIG. 4) is connected between flange 92 and the side of primer tray 78 adjacent to pivotal connection 90 to prevent the primers 82 from passing between the end of flange 90 and the adjacent wall of tray 78, to agitate the primers as arm 88 moves, and to direct primers 82 toward dispenser opening 84.

Primer tray 78 preferably has a transparent top 79 (FIG. 5) which is attached to a support strip 83 which is pivoted at 85 to opposed sides of tray 78. Transparent top 79 is snap fitted over the top of tray 78 by means of snap fittings 87. Transparent top 79 permits the operator to see when the supply of primers 82 is running low and can be easily opened to replenish the supply. An alternate opening 85 is provided so that top 79 may be placed at a height that prevents primers from tipping over from the required upright position in the tray 78, of common primer sizes.

An opening 96 is formed in the bottom 98 of primer tray 78 and an actuation arm 100 extends through opening 96 underneath tray bottom 98. Actuation arm 100 is formed by cutting a portion of dispenser arm 88 free at 102 and then bending the free portion to form actuation arm 100. As shown in FIGS. 1 and 5, actuation arm 100 is connected by a link 104 to an L-shaped lever 106 which is pivotally connected at 108 (FIG. 1) to support bracket 80, which in turn is connected to tool carriage 16. Lever 106 is pivoted about point 108 when it is desired to dispense a primer 82 as described hereinafter.

As shown in FIGS. 4 and 6, the free end of dispenser arm 88 is notched at 110 to receive one primer 82 and to move the same over dispenser opening 84 when dispenser arm 88 is pivoted toward dispenser opening 84. In the normal unactuated position of dispenser arm 88 (FIG. 4), the lower margin 112 of notch 110 is spaced close enough to the adjacent side 114 of primer tray 78 to prevent the lowermost primer 82 from passing between dispenser arm 88 and primer tray side 114. However, the upper margin 116 of notch 110 is spaced far enough away from primer tray side 114 to allow the lowermost primer 82 to pass through so that it can enter notch 110. When dispenser arm 88 is pivoted toward dispenser opening 84, it carries the lowermost primer 82 with it and drops it through dispenser opening 84. When dispenser arm 88 begins to move toward a position to drop primer 82 down dispenser opening 84, the upper margin 116 of notch 110 immediately moves close enough to primer tray side 114 to prevent the next primer 82 from entering notch 110 and the curve 117 at the end of arm 88 is such that the next primer remains in position to enter notch 110. The next primer 82 enters notch 110 when dispenser arm 88 is moved back to its unactuated position as shown in FIG. 4.

In this particular embodiment of the invention, it is necessary to actuate dispenser arm 88 only once for each complete loading cycle for each shotgun shell being reloaded. This is preferably done on the final crimping step of the reloading cycle. The mechanism for actuating dispenser arm 88 is shown in FIGS. 1–3. Referring to FIG. 2, a lever arm 118 is pivotally connected at 120 to bracket 80 and extends between the bottom edge 122 of L-shaped lever 106 (FIG. 1) and the top of crimping die 44. Lever arm 118 is spring biased in its unactuated position by an expansion spring 124 which is stretched between bracket 80 and the end of lever arm 118 under L-shaped lever 106. When a reloaded shell is under crimping die 44, the shell causes die 44 to rise relative to carriage 16 and causes lever arm 118 to rock counter-clockwise in FIG. 2 as tool carriage 16 approaches its lowermost position. This rocks L-shaped lever 106 counter-clockwise in FIG. 1 and moves dispenser arm 88 from its unactuated position (FIG. 4) to its actuated position (FIG. 6), thus dropping a primer 82 down dispenser tube 86 and primer tube and inserting ram 46. At the time primer 82 drops down tube 46, the bottom of tube 46 is adjacent to the collar 66 (FIG. 1) so that the primer 82 drops into opening 68 in collar 66 and rests on top of anvil 64 in preparation for seating of the fresh primer in the base 74 of a shell 76 as described previously. After the crimping operation is completed, tool carriage 16 rises, which allows lever arm 118 and L-shaped lever 106 to rotate clockwise under the urging of spring 124, thereby moving dispenser arm 88 back to the unactuated position shown in FIG. 4.

As shown in FIG. 3, crimping die 44 is movably supported on tool carriage 16 by a support bracket 126 which has a lip 128 and collar 130 that loosely engage a rod 132 on tool carriage 16. A cam roller 134 is attached to the top of bracket 126 and engages a cam surface 136 which is attached to lever arm 22 and bears against cam roller 134 on the bottom of the downward stroke of lever arm 22.

In order to initiate the primer feed operation described above, it is necessary that the downward movement of crimping die 44 be arrested by encountering a shotgun shell therebelow. If no shotgun shell is encountered, lever arm 118 does not get rotated counter-clockwise in FIG. 2, and primer dispensing lever 88 remains in the unactuated position. Thus it is possible to lower carriage 16, performing the operations of ejecting the spent primer, seating the fresh primer, and charging the shell with shot and powder without dispensing unwanted primers. The primers are dispensed only on the final crimping step when the presence of a shotgun shell beneath crimping die 44 causes lever arm 118 to rotate counter-clockwise in FIG. 2.

Figure 7:
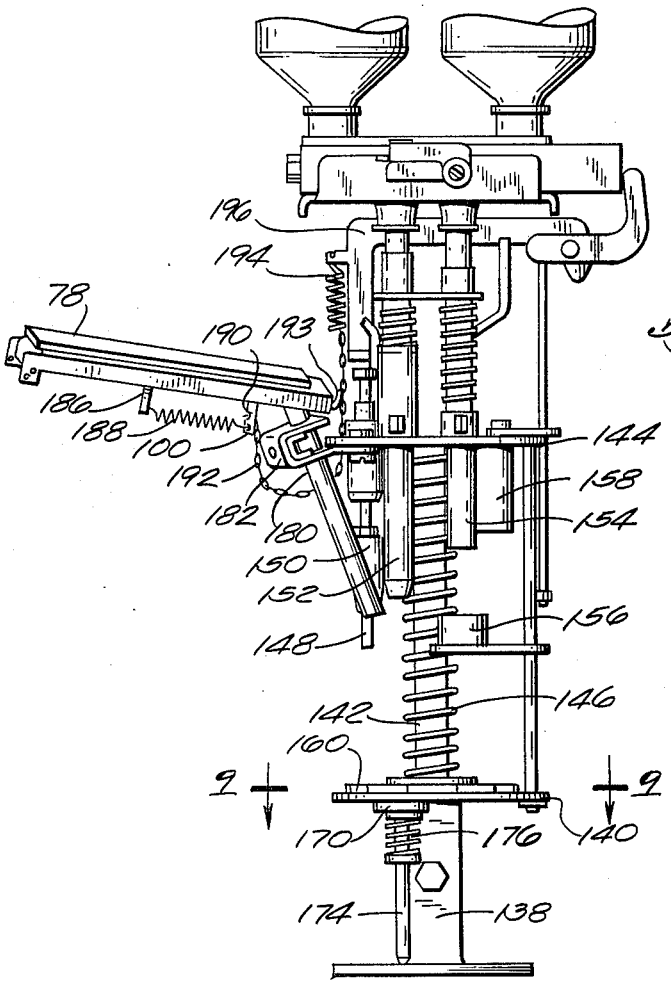
FIG. 7 is a front elevational view of a second embodiment of the invention mounted on a second type of shotgun shell reloader.

FIG. 7 shows a second embodiment of the invention used in combination with a different type of reloader in which the operations of ejecting the spent primer, seating the fresh primer, charging the shell with powder, wadding, and shot, and crimping the shell are performed simultaneously on a plurality of shotgun shells which move from one station to another. This type of shotgun shell reloader is described in my prior U.S. Pats. No. 3,157,086 and No. 3,240,104, the entire disclosures of which are hereby incorporated herein by reference. Referring to FIG. 7, this shotgun shell reloader includes a base 138 which supports a work table 140 and a post 142 which projects upwardly from the center of work table 140. A tool carriage 144 is slideably mounted on post 142 and is normally urged upwardly by a compression spring 146. A group of reloading tools including a primer ejection punch 148, sizing die 150, powder tube and primer inserting ram 152, shot tube 154, wad support 156, and crimping tool 158 are supported on tool carriage 144 and project downwardly therefrom. Tool carriage 144 and the associated reloading tools can be manually lowered toward work table 140 by means of a conventional lever arm and handle which are not shown in the drawing.

This embodiment of the invention has a radially notched turret disc 160 (FIGS. 7 and 9) which is rotatably attached to the top of work table 140 and has six radially disposed slots 162 which are dimensioned to receive the ferrule portion of an empty shotgun shell and hold the same in position below a corresponding one of the reloading tools. All of the shotgun shells in turret disc 160 are simultaneously rotated from one reloading tool to the next when disc 160 is rotated from one position to the next. During the reloading process, six shotgun shells are normally carried by turret disc 160 and the six different reloading operations are performed simultaneously on the six shells every time tool carriage 144 is moved downwardly to bring the reloading tools into contact with the shotgun shells. At reloading position No. 164 (FIG. 9) the spent primer is ejected from the empty shell by primer punch 148 and drops through an opening 166 in work table 140. At the next reloading position No. 168, a fresh primer is inserted in a shell whose spent primer was ejected in the preceeding reloading operation. The insertion of the fresh primer is effected by powder tube and primer inserting ram 152, which presses the base of the deprimed shell onto a repriming structure which includes a collar 170 with a central opening 172 that is large enough to admit a fresh primer, an anvil rod 174 (FIG. 7) which extends partially within opening 170 and rigidly supports the fresh primer, and a compression spring 176 which is rigidly attached at its bottom to anvil 174 and bears against the bottom of collar 170. Spring 176 normally urges collar 170 upward but yields in response to the pressure applied to the base of the shell by ram 152. As collar 170 moves downward, a fresh primer is held stationary within the opening in the base of the shell by anvil rod 174, whereby the downward movement of collar 170 causes the fresh primer to seat in the opening in the base of the shell. Since the repriming operation is performed every time tool carriage 144 is lowered, it is necessary to deposit a fresh primer within the opening 172 of collar 170 on every downward cycle of tool carriage 144. In the past, this was done by manually depositing a fresh primer in the opening 178 in turret disc 160 between reloading stations 164 and 168. Then when turret disc 160 was manually rotated counter-clockwise to advance the shotgun shells to the next reloading stations, the fresh primer fell from opening 178 into opening 172 in position to be seated in the base of the shell whose spent primer had been ejected in the previous reloading operation. Primer openings 178 were provided in turret disc 160 between each adjacent pair of radial slots 162 therein so that one opening 178 would fall between reloading positions 164 and 168 on every reloading operation.

In accordance with this invention, the above-described manual primer feed is obviated by means of an automatic primer feed mechanism that deposits a new primer into the opening 178 between reloading stations 164 and 168 on every downward movement cycle of tool carriage 144. The primer feed mechanism comprises a primer tray 78 as described previously which has an elongated primer dispenser tube 180 which is welded at its top end around the primer dispenser opening of tray 78 and projects downwardly therefrom. Primer tray 78 is rigidly connected to tool carriage 144 by means of a bracket 182 which is bolted to tool carriage 144 and has openings therein to slideably receive dispenser tube 180 and has a set screw 184 for securing dispenser tube 180 thereto at any desired position. Bracket 182 is so dimensioned and so positioned on tool carriage 144 as to direct the lower end of dispenser tube 180 to a predetermined primer dispenser location directly above the primer opening 178 (FIG. 9) between reloading stations 164 and 168.

The particular primer tray 78 used in this embodiment has a stud 186 projecting downward from the bottom thereof and an expansion spring 188 connected between stud 186 and actuation arm 100 to normally hold the dispenser arm of primer tray 78 in its unactuated position when tool carriage 144 is in its upper position. Actuation arm 100 is slotted at 190 to receive a beaded chain 192 whose other end is connected to an expansion spring 194 which in turn is connected to a fixed bracket 196. Bracket 196 is attached to post 142 and remains stationary when tool carriage 144 is lowered. Therefore, the slack in chain 192 is taken up when tool carriage 144 is lowered and chain 192 pulls actuation arm 100 to the right in FIG. 7 to dispense a fresh primer down dispenser tube 180 when it is positioned immediately above the primer opening 178 (FIG. 9) between the primer ejection station 164 and the primer insertion station 168. The time at which the fresh primer is dropped down dispenser tube 180 can be controlled by varying the length of chain 192. This can be easily done by disengaging the end of chain 192 from slot 190 and then engaging a different pair of beads of chain 192 in slot 190 to either lengthen chain 192 or shorten it as desired.

Figure 9:
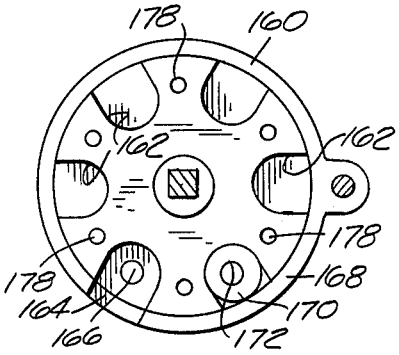
FIG. 9 is a fragmentary plan view taken on the line 9—9 of FIG. 7.

Each time tool carriage 144 is moved downward to bring the reloading tools into contact with the shotgun shells on work table 140, chain 192 pulls actuation arm 100 to the right in FIG. 7 and dispenses a fresh primer down primer dispenser tube 180 into the primer opening 178 of turret disc 160 (FIG. 9). As tool carriage 144 rises back to its rest position, spring 188 draws actuation arm 100 back to its unactuated position. A curved shoulder 193 is preferably attached to the bottom of tray 78 to provide a curved surface upon which chain 192 can slide.

Figure 8:
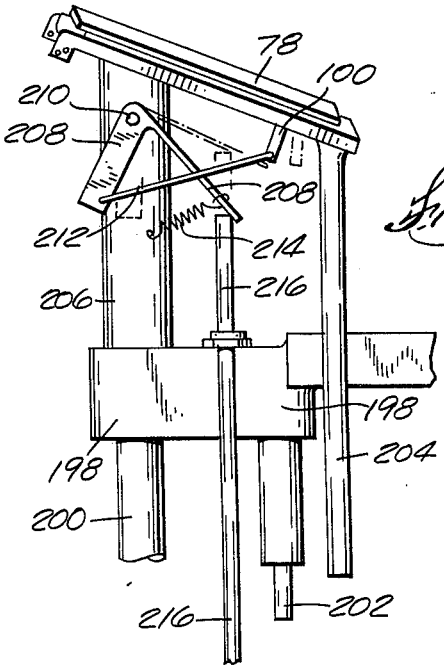
FIG. 8 is a side elevational view of a third embodiment of the invention mounted on a third type of shotgun shell reloader, only the upper portion of the reloader being shown.

The primer feed mechanism of this invention is also applicable to the type of shotgun shell reloader in which the tool carriage is stationary and the work table can be moved up beneath the reloading tools to effect the reloading operations. The portions of an illustrative type of reloader which are adjacent to the primer feed mechanism are shown in FIG. 8. One corner portion of a fixed tool carriage 198 is supported by a fixed support rod 200, the other corner of tool carriage 198 (not shown) being supported by a similar support rod, both of which are supported on a base (not shown). Tool carriage 198 supports a plurality of reloading tools including a primer ejection punch 202, a primer dispenser tube 204, and other conventional reloading tools, not shown. Primer dispenser tube 204 is attached to the bottom of a primer tray 78 such as shown in FIGS. 4–6 and described previously. Primer tray 78 is supported by a bracket 206 which projects upwardly from tool carriage 198 and is bolted to the bottom of tray 78, which is supported in an inclined position to gravity bias the primers therewithin toward the corner thereof carrying the dispenser opening and dispenser tube 204. A lever arm 208 which is shaped like an inverted V is pivotally connected at 210 to bracket 206. A rigid link 212 is connected between one end of lever arm 208 and the actuation arm 100 of primer tray 78. The other end of lever arm 208 is connected to an expansion spring 214 which urges lever arm 208 clockwise in FIG. 8 and thereby draws actuation arm 100 toward its unactuated position. When the work table (not shown) of this reloader is raised, a rod 216 which is attached thereto rises and causes lever arm 208 to rotate counter-clockwise in FIG. 8, which moves link 212 and actuation arm 100 to dispense a fresh primer out of dispenser tube 204, which is positioned to deliver the primer to a predetermined delivery point on the reloader's work table (not shown).

Other forms of actuating mechanism may be used.

I claim:

1. A primer feed mechanism for use in combination with a shotgun shell reloader having a work table to support shotgun shells to be reloaded, and having a tool carriage mounted above said work table and at least a primer inserting tool mounted on said tool carriage, and having reloading actuation means for producing relative motion between said work table and said tool carriage to bring said primer inserting tool into contact with a deprimed shotgun shell, said primer feed mechanism comprising a primer tray mounted on said tool carriage, said primer tray being dimensioned to hold a plurality of shotgun shell primers therewithin and having a dispenser opening therein, means urging primers on the tray toward said dispenser opening, primer dispenser means for moving one primer at a time over said dispenser opening when actuated to drop said primer through said dispenser opening, a dispenser tube attached to said tray under said dispenser opening and extending downwardly therefrom and terminating above a predetermined primer delivery location with respect to said work table, and means coupling said reloading actuation means to said primer dispenser means to cause one primer to drop down said dispenser tube at a predetermined position of said reloading actuation means for each time a primer is to be inserted in a shell by said primer inserting tool.

2. A primer feed mechanism as defined in claim 1 wherein said primer urging means include said primer tray being tilted toward said dispenser opening therein so that the primers in said tray are urged toward said dispenser opening by the force of gravity.

3. A primer feed mechanism as defined in claim 1 wherein said primer dispenser means comprises a primer dispenser arm pivotally connected at one end to the bottom of said primer tray and having a notch in the other end of said arm large enough to receive only one of said primers in said tray, said dispenser arm being movable between an unactuated position where said notch is spaced from said dispenser opening and an actuated position where said notch is aligned above said dispenser opening to allow the primer in said notch to drop through said dispenser opening.

4. A primer feed mechanism as defined in claim 3 wherein said dispenser opening is formed in one bottom end of said tray and said dispenser arm is pivotally connected to the other side of the same bottom end of said tray.

5. A primer feed mechanism as defined in claim 3 and further comprising spring means normally urging said dispenser arm toward the unactuated position thereof.

6. A primer feed mechanism as defined in claim 3 wherein the notched end of said dispenser arm is adjacent to one side of said tray and is close enough to said side to cause the primers in said tray to funnel down between the notched end of said dispenser arm and the adjacent side of said tray, said notch being so oriented as to receive the lowermost primer in the funneled portion of said tray when said dispenser arm is in its unactuated position, and the end portion of said dispenser arm above said notch being so shaped as to block movement of said primers in the funneled portion of said tray when said dispenser arm is moved to its actuated position to drop said lowermost primer down said dispenser opening.

7. The primer feed mechanism defined in claim 3 wherein there is an opening in the bottom of said primer tray under said dispenser arm, and wherein a portion of said dispenser arm projects downwardly through said opening and forms an actuation arm through which said dispenser arm can be moved from its unactuated position to its actuated position.

8. The primer feed mechanism defined in claim 7 wherein said reloading actuation means is operable to move said tool carriage relative to said work table, and wherein said means coupling said primer dispenser means to said reloading actuation means comprises a linkage coupled between said actuation arm and a stationary part of said shotgun shell reloader.

9. The primer feed mechanism defined in claim 8 wherein said linkage is flexible and extends from said actuation arm to said stationary part of said shotgun shell reloader.

10. The primer feed mechanism defined in claim 9 wherein said linkage is a beaded chain and wherein said actuation arm extends downwardly below the bottom of said primer tray and is slotted to receive said beaded chain at adjustable positions to control the timing of primer feeding.

11. The primer feed mechanism defined in claim 7 wherein said shotgun shell reloader includes a crimping tool mounted on said tool carriage, said reloading actuation means being operable to move said tool carriage downwardly relative to said work table, said crimping tool being mounted so that its downward movement is arrested when it contacts a shotgun shell to be crimped, and wherein said means coupling said primer dispenser means to said reloading actuation means comprises a linkage coupled between said actuation arm and said crimping tool to actuate said primer dispenser when said crimping tool contacts a shotgun shell to be crimped.

12. The primer feed mechanism defined in claim 1 wherein said primer tray has a transparent top which is pivotally connected to opposing sides of said primer tray in a position to confine generally cylindrical primers against tipping respecting said tray and cover.

13. The device of claim 12 wherein the position of the cover is adjustable in height above said tray.

* * * * *